US005955172A

United States Patent [19]

Hürten

[11] Patent Number: 5,955,172

[45] Date of Patent: Sep. 21, 1999

[54] SHOE WITH A VENTILATION LAYER

[75] Inventor: Joachim Hürten, Haan, Germany

[73] Assignee: Akzo Nobel NV, Arnhem, Netherlands

[21] Appl. No.: 09/015,663

[22] Filed: Jan. 29, 1998

[30] Foreign Application Priority Data

Jan. 29, 1997 [DE] Germany ..... 197 03 186

[51] Int. Cl.[6] ..... A43B 7/06

[52] U.S. Cl. ..... 428/116; 36/3 A; 36/3 B; 36/3 R; 36/44

[58] Field of Search ..... 36/3 R, 3 A, 3 B, 36/44; 428/116

[56] References Cited

U.S. PATENT DOCUMENTS 5,014,363 5/1991 Hubner et al. .
5,433,021 7/1995 Mahler .

FOREIGN PATENT DOCUMENTS 0 350 611 1/1990 European Pat. Off. .
0 434 934 7/1991 European Pat. Off. .
686 498 A1 12/1995 European Pat. Off. .
38 20 099 C2 12/1989 Germany .
43 36 303 4/1995 Germany .

OTHER PUBLICATIONS

Derwent Abstract 89–371626, English language abstract corresponding to DE 38 20 099 C2.

Derwent English–language Abstract corresponding to EP 686 498 A1.

*Primary Examiner*—Christopher Raimund
*Attorney, Agent, or Firm*—Oliff & Berridge, PLC

[57] ABSTRACT

A shoe with an outer layer and a ventilation layer positioned against the inside of the outer layer. The ventilation layer has a flat textile structure, at least on its side which is turned towards the inside of the shoe, which is held at a distance from the outer layer by spacers. The flat textile structure turned towards the inside of the shoe contains between 30 and 100 weight percent multifilament flat yarns made of synthetic polymers and between 0 and 70 weight percent other yarns. In particular, these flat yarns have a filament titre of at least 3 dtex. The flat textile structure which is turned towards the inside of the shoe is significantly more durable than those conventionally used.

8 Claims, No Drawings

SHOE WITH A VENTILATION LAYER

BACKGROUND OF THE INVENTION

1. Field of the Invention

The invention relates to a shoe with an outer layer and a ventilation layer positioned against the inside of this outer layer, the ventilation layer having a flat textile structure, at least on its side which is turned towards the inside of the shoe, which is held at a distance from the outer layer by spacers.

2. Description of Related Art

A shoe of this kind has become well known from publication EP-A-0 686 498. In order to achieve an attractive visual effect and also because of the comfort required inside the shoe, the flat textile structures which are turned towards the inside of the shoe are generally produced from natural-fiber yarns or textured multifilament yarns. Experience has shown here that pilling can be observed to occur on the inner side of the flat textile structure after a relatively short wearing time. The form this process takes is that first small pills and then later also larger burls and neps appear, which are formed by fibers and filament ends that are rubbed out of the flat textile structure. In cases where the shoes continue to be worn, initially small and then increasingly large holes have been observed to form in the surface of the flat textile structure.

SUMMARY OF THE INVENTION

An object of the invention is therefore to improve a shoe of the type initially described to the effect that the pilling on the side which is turned towards the inside of the shoe is reduced and therefore the durability of the inside of the shoe improved.

This and other objects are solved in a shoe of the type initially described wherein at least the flat textile structure turned towards the inside of the shoe contains between 30 and 100 weight percent multifilament flat yarns produced from synthetic polymers and between 0 and 70 weight percent other yarns.

DETAILED DESCRIPTION OF PREFERRED EMBODIMENTS

Preferably, at least the flat textile structure turned towards the inside of the shoe contains between 50 and 100 weight percent multifilament flat yarns made of synthetic polymers. Surprisingly, it has been found that a considerable improvement can be achieved with regard to pilling by using as little as approximately 30 weight percent multifilament flat yarns made of synthetic polymers. It has been found that when a proportion of multifilament flat yarns as low as approximately 50 weight percent is used, the pilling often does not begin until after double the wearing time possible when multifilament flat yarns are not used.

Most preferably, the other yarns are textured multifilament yarns.

The flat textile structure can be formed from practically all flat textile structures which are made of yarns, such as woven fabrics, knitted fabrics and nonwovens.

The shoe should preferably be one in which the ventilation layer is a knitted spaced fabric, whereby one of the two knitted fabrics held at a distance forms the flat textile structure which is turned towards the inside of the shoe. This is generally a simplex fabric, which is usually manufactured on a warp knitting machine with, for example, between 5 and 7 guide bars, whereby at least 2 guide bars feed the same type of yarn into the knitting process at any one time. Suitable spaced fabrics have become well known under the name of double raschel plush. Knitted spaced fabrics of this kind are described in publication EP-A-0 686 498 mentioned previously, incorporated herein by reference. The materials from which the knitted spaced fabric is made are not, however, specified in that publication.

Generally, the two knitted fabrics which form the outer flat textile structures are connected by monofilaments which run back and forth between them, whereby these monofilaments guarantee that the distance required for ventilation purposes is maintained. With a knitted spaced fabric of this kind, the weight percentages specified for the multifilament flat yarns and the other yarns in the present invention relate to the knitted fabric without the monofilaments which run back and forth between the two outer knitted fabrics. This means that the weight percentages for the flat textile structure specified for the invention relate to the flat textile structure itself, that is, to embodiments in which the flat textile structure exists as such and without connection to a second flat textile structure. These percentages in the different yarns are set by adjusting the quantities of different yarns fed in during production of the knitted fabric accordingly.

The shoe should preferably be of a type in which the knitted fabric is manufactured using a method by which the flat yarn is fed in over at least one guide bar.

It has been found advantageous in the shoe of the invention for the flat yarn to have a filament titre of at least 3 dtex, and preferably between 3 and 4 dtex. When flat yarns of this kind are used, it has been found that pilling begins considerably later than with flat textile structures of the type conventionally used.

The comfort of the shoe may be further increased for the wearer if a waterproof, water-vapor permeable functional layer is positioned between the ventilation layer and the outer layer.

A shoe in which all the filaments in the ventilation layer and the functional layer are manufactured from a polymer of the same class is particularly advantageous. This is a particularly simple method of achieving the type purity necessary for recycling.

The shoe of the invention may be made suitable for recycling in a particularly successful manner if all the filaments in the ventilation layer and the functional layer are made of polyesters, in particular the class of polyethylene terephthalates and possibly co-polymers thereof. A waterproof, water-vapor permeable membrane which has become well-known under the name of SYMPATEX® has proven particularly successful as a functional layer. This membrane is also available as a laminate, for example laminated onto a flat textile structure.

EXAMPLES

Two simplex warp-knitted fabrics are produced, whereby fabric A is a known fabric used in shoes and fabric B is a fabric in accordance with the invention.

The two outer faces of warp-knitted fabric A contain 70 weight percent textured yarn 76 dtex f36 and 30 weight percent textured yarn 150 dtex f24, whereby both yarns are manufactured from polyethylene terephthalate. The spacer is formed with monofilaments with a titre of 33 dtex manufactured from polyethylene terephthalate which are woven into the two outer faces so that they run back and forth between them.

The two outer faces of warp-knitted fabric B contain 70 weight percent flat yarn 76 dtex f24 and again 30 weight percent textured yarn 150 dtex f24, whereby both yarns are manufactured from polyethylene terephthalate. The spacer is formed with monofilaments with a titre of 33 dtex manufactured from polyethylene terephthalate which are woven into the two outer faces so that they run back and forth between them.

Both simplex fabrics are subjected to an abrasion test in a wet state, in accordance with SATRA Test Method PM 31 (the SATRA Martindale Abrasion Machine for upper and lining materials), March 1989. The first pills (tiny burls) are visible on fabric A after approximately 5,000 abrasion cycles and the first small holes appear after approximately 10,000 abrasion cycles, while the first pills do not appear on fabric B until after approximately 20,000 abrasion cycles and the first small holes after approximately 30,000 abrasion cycles. Consequently, the lifetime of the warp-knitted fabric in the shoe can be increased significantly through use of the flat yarns required by the invention.

What is claimed is:

1. A shoe comprising an outer layer and a ventilation layer positioned against an inside of the outer layer, wherein the ventilation layer has a flat textile structure at least on a side of the ventilation layer which is turned towards an inside of the shoe, wherein the flat textile structure is held at a distance from the outer layer by spacers, wherein at least the flat textile structure turned towards the inside of the shoe comprises between 30 and 100 weight percent multifilament flat yarns made of synthetic polymers and between 0 and 70 weight percent other yarns wherein the multifilament flat yarn has a filament titre of at least 3 dtex, and wherein the ventilation layer is a knitted spaced fabric in which one of two knitted fabrics held at a distance forms the flat textile structure which is turned towards the inside of the shoe.

2. A shoe in accordance with claim 1, wherein at least the flat textile structure turned towards the inside of the shoe comprises between 50 and 100 weight percent multifilament flat yarns made of synthetic polymers.

3. A shoe in accordance with claim 1, wherein the other yarns are textured multifilament yarns.

4. A shoe in accordance with claim 1, wherein the knitted fabric is manufactured using a method in which the flat yarn is fed in over at least one guide bar.

5. A shoe in accordance with claim 1, wherein the multifilament flat yarn has a filament titre of between 3 and 4 dtex.

6. A shoe in accordance with claim 1, wherein the shoe further comprises a waterproof, water-vapor permeable functional layer between the ventilation layer and the outer layer.

7. A shoe in accordance with claim 6, wherein the yarns in the ventilation layer and the functional layer comprise a same polymer.

8. A shoe in accordance with claim 6, wherein the yarns in the ventilation layer and the functional layer comprise a polyethylene terephthalate.

* * * * *